US005336158A

United States Patent [19]

Huggins et al.

[11] Patent Number: 5,336,158

[45] Date of Patent: Aug. 9, 1994

[54] PNEUMATIC VACUUM VIBRATOR APPARATUS

[76] Inventors: Freddie L. Huggins, P.O. Box 332, Munford, Tenn. 38058; Donald L. Fleming, 9376 Barley Mills Rd., Memphis, Tenn. 38133

[21] Appl. No.: 975,060

[22] Filed: Nov. 12, 1992

[51] Int. Cl.[5] ..... A61H 1/00

[52] U.S. Cl. ..... 601/14; 601/46

[58] Field of Search ..... 601/14, 6, 11, 12, 13, 601/15, 16, 46, 78, 80

[56] References Cited

U.S. PATENT DOCUMENTS

| | | | |
|---|---|---|---|
| 1,651,585 | 12/1927 | Clair | 128/32 |
| 1,861,924 | 5/1930 | Karlström | 128/38 |
| 2,561,034 | 7/1951 | Phillips | 128/38 |
| 2,616,417 | 5/1950 | Holbrook . | |
| 2,668,315 | 2/1954 | Crosby | 128/38 |
| 3,382,867 | 3/1965 | Reaves . | |
| 3,500,832 | 10/1967 | Nunnery . | |
| 3,913,569 | 10/1975 | Kanonas | 128/40 |
| 4,029,088 | 6/1977 | Wu . | |
| 4,111,192 | 9/1978 | Wu . | |
| 4,203,431 | 5/1980 | Abura | 128/39 |
| 4,584,992 | 12/1983 | Liu . | |
| 4,722,326 | 2/1988 | Ruderian | 128/24.1 |
| 4,748,973 | 6/1988 | Cho . | |
| 4,765,316 | 8/1988 | Marshall | 128/39 |
| 5,099,830 | 3/1992 | Kishimoto . | |

FOREIGN PATENT DOCUMENTS

| | | | |
|---|---|---|---|
| 365230 | 4/1990 | European Pat. Off. | 128/38 |
| 530752 | 7/1931 | Fed. Rep. of Germany | 128/36 |

*Primary Examiner*—Robert A. Hafer
*Assistant Examiner*—David J. Kenealy
*Attorney, Agent, or Firm*—Litman, McMahon & Brown

[57] ABSTRACT

The present invention relates generally to a compact, portable hand-held electrical pneumatic vacuum apparatus which includes a vibrator. More particularly, it is concerned with a vacuum vibrator having a cup for receiving a body surface coupled with a unitary housing incorporating a handle, a blower for exhausting air from the housing and thereby creating a suction force in the cup, and structure for imparting a vibrating action to the cup.

5 Claims, 1 Drawing Sheet

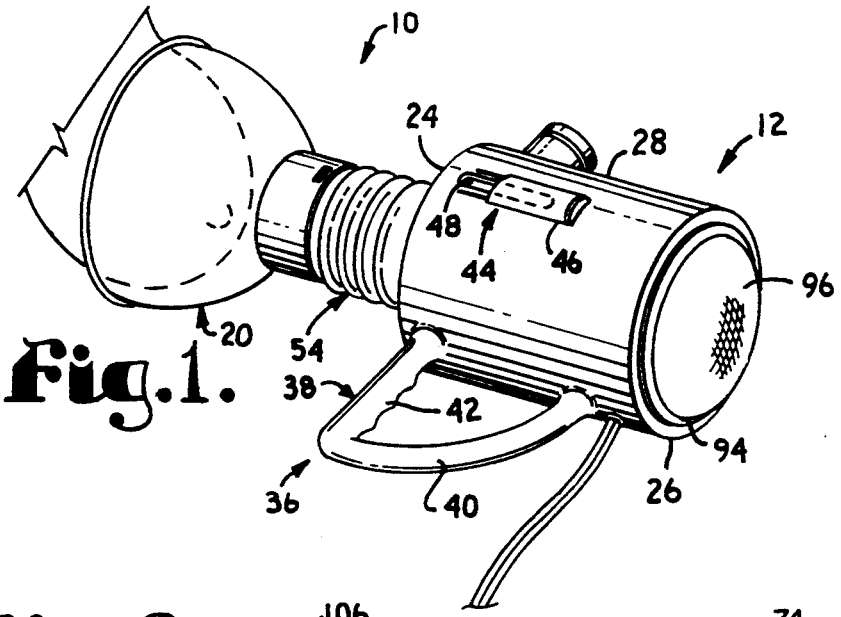
Fig.1.
Fig.2.
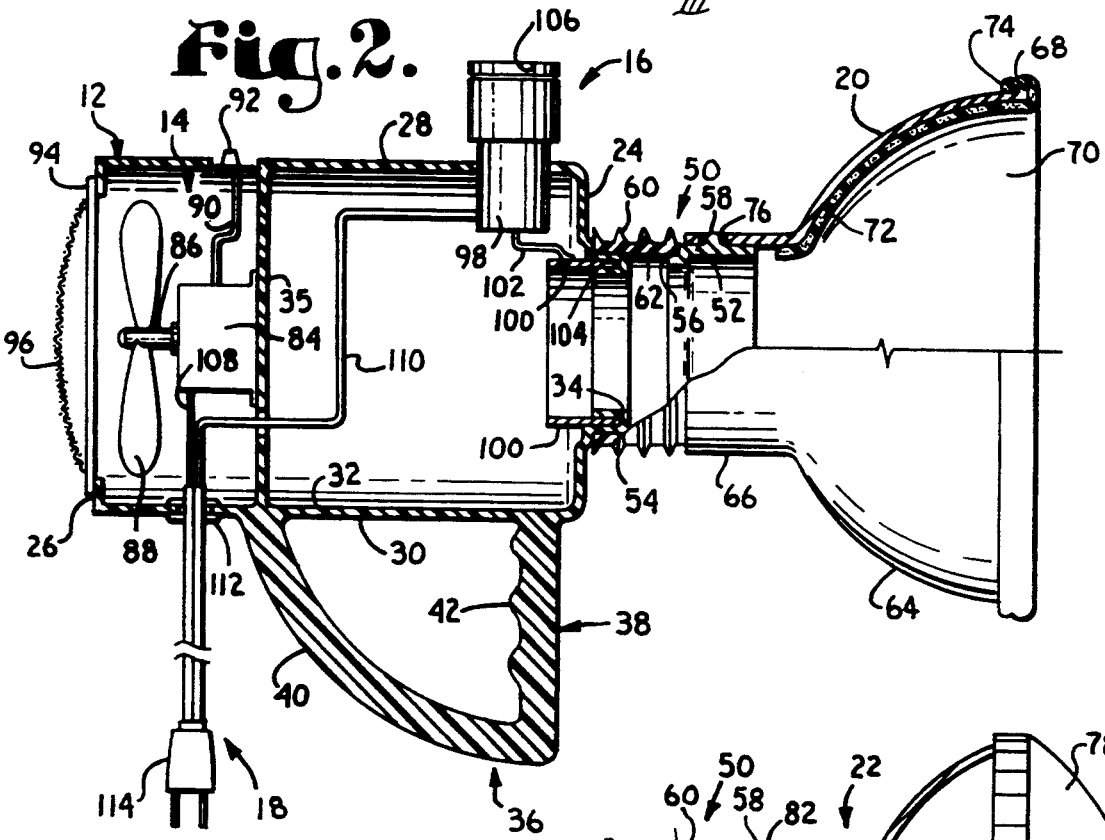
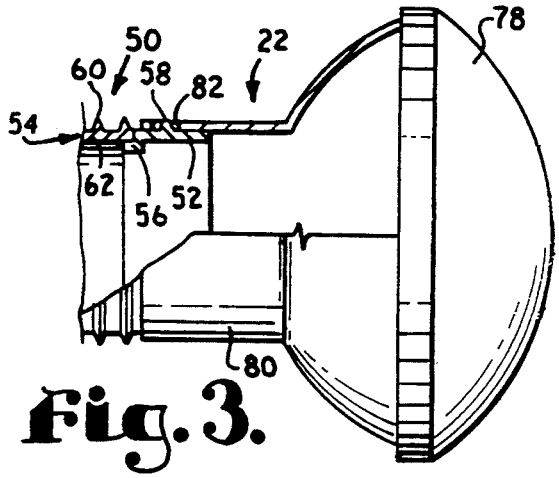
Fig.3.

PNEUMATIC VACUUM VIBRATOR APPARATUS

BACKGROUND OF THE INVENTION

1. Field of the Invention

The present invention relates generally to a compact, portable hand-held electrical pneumatic vacuum apparatus which includes a vibrator. More particularly, it is concerned with a vacuum vibrator having a cup for receiving a body surface coupled with an integral housing incorporating a handle, a blower for exhausting air from the housing and thereby creating a suction force in the cup, and structure for imparting a vibrating action to the cup.

2. Description of the Related Art

Devices imparting vacuum suction and vibration are employed to soothe and massage muscles subject to fatigue or strain caused by exercise and overexertion and to impart systematic therapeutical friction to various portions of the body. Prior art patents have recognized the use of vacuum and massage devices for various therapeutic uses: U.S. Pat. No. 4,748,973 to improve circulation of the blood; and U.S. Pat. Nos. 3,382,867, 4,029,088 and 4,111,192 for exercise, strengthening and development of selective muscles.

Previous prior art devices have been employed to impart either vacuum suction or vibration to portions of the body. Some of these devices have employed hydraulic means to impart suction and vibration. However, such prior art devices required connection to a water source, which impaired portability and required water temperature control means for comfortable use. Other devices obtained suction by means of foot or hand operated bellows. Such manually operated equipment was cumbersome and fatiguing to operate. Still other devices employed a single pneumatic means to impart both suction and vibration. However, in such devices the magnitude of suction and vibration were not independently variable.

SUMMARY OF THE INVENTION

The present invention overcomes the problems previously outlined and provides a greatly improved hand-held pneumatic vacuum vibrator apparatus. The vacuum vibrator of the present invention provides both suction and vibration in an integral, compact, easily portable, unit which may be conveniently used in privacy.

The electrical vacuum vibrator in accordance with the present invention broadly includes an apertured cup-shaped member having structure defining a passageway for permitting evacuation of air from the cup, coupled with a compact, unitary housing, a blower for exhausting air from the housing and drawing air inwardly through the cup-shaped member to create a suction force therein, and a vibrator. Preferably, the housing walls include structure defining a baffle member which permits admission of air therein to modulate the suction force exerted on the body portion, and a handle for ease of use and portability.

In particularly preferred forms, the cuplike member is removably coupled with the housing, for removal and replacement with a bulb-shaped massage member. In addition, a power supply and speed control switch permitting independent regulation of the blower and vibrator are located within the housing and respectively remotely coupled with the blower and vibrator.

OBJECTS AND ADVANTAGES OF THE INVENTION

The principal objects and advantages of the present invention include: providing a pneumatic vacuum vibrator apparatus which is particularly well-adapted to soothe and massage muscles, to increase blood circulation, and to impart therapeutical friction to various portions of the body; providing vacuum suction and vibration which are electrically operated; providing vacuum suction and vibration which are independently variable; providing a vacuum vibrator apparatus in which the vacuum is provided by a blower structure; providing such an apparatus which is compact, hand-held and convenient to operate; providing such an apparatus which is easily portable; providing such an apparatus having an adjustable baffle for modulating the suction force exerted on a body portion; and providing such an apparatus which cushions the body portion for comfort of the user.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a pneumatic vacuum vibrator apparatus in accordance with the present invention;

FIG. 2 is a side elevation of the apparatus depicted in FIG. 1, with portions broken away to illustrate the blower, vibrator and interior of the housing and cup; and FIG. 3 is a side elevation of the massage assembly and a portion of the housing, with portions broken away to show the coupling.

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

INTRODUCTION AND ENVIRONMENT

Certain terminology will be used in the following description for convenience in reference only and will not be limiting. For example, the words "upwardly", "downwardly" "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring now to the drawing, a vacuum vibrator apparatus 10 in accordance with the invention broadly includes a housing 12, containing a fan assembly 14, vibrator assembly 16 and electrical power source 18. A cup assembly 20 is coupled with housing 12 for receiving a body surface to be subject to vacuum vibration (see FIGS. 1 and 2). In alternate embodiments as best shown in FIG. 3, a massage assembly 22 is substituted for cup-shaped member 20.

In more detail, housing 12 is of integral construction, presenting front and rear portions 24, 26, and a generally cylindrical body 28 having exterior and interior surfaces 30, 32. Front portion 24 is apertured to permit air to be drawn inwardly by fan 14, and includes a forwardly projecting U-shaped lip 34. Rear portion 26 is likewise apertured to permit exhaustion of air from the housing by fan 14. Housing body interior 32 includes structure defining a partition 35, which is partial or perforate so as to permit free flow of air inwardly from the apertured front portion 24, throughout housing 12, and outwardly through apertured rear portion 26. Exterior housing surface 30 is configured to present at least one generally quadrant shaped handgrip 36, including a transverse stem portion 38 and a hemiarcuate portion 40. Certain preferred embodiments include a pair of opposed handgrips to enhance stability during use and prevent cramping of the muscles of the hand. Stem 38 includes inwardly-facing structure defining grooves to accommodate the fingers of a user. Housing body 28 includes a baffle assembly 44 having a hemi-cylindrical plate 46 in sliding, overlapping engagement with a slot-shaped aperture 48.

Connector assembly 50 includes a cup-supporting sleeve and generally cylindrical shaped bellows member 54 for removably coupling housing assembly 12 with cup member 20. Sleeve 52, includes a housing front-facing lip 56 at one end and exterior opposed clips 58. Generally cylindrical shaped bellows member 54, includes a ridged outer surface 60 and an inner surface 62. Bellows 54 is fixedly attached at each end to opposed front housing lip 34, and sleeve lip 56.

Cup assembly 20 includes a curved portion 64 integrally coupled with a shank portion 66 for concentric coupling with sleeve 52 in telescopic relationship. Curved portion 64 presents an outer marginal lip 68, and an inner cavity 70. A liner 72 is configured to conform to the inner surface of cavity 70, and extend over lip 68 to be held in place by an integral annular rib 74. Shank portion 66 includes structure defining opposed apertures 76 for mating engagement with housing connector sleeve clips 58. Massage assembly 22, employed in alternate embodiments of the invention, includes an arcuate head portion 78 coupled with a shank portion 80 including structure defining a pair of opposed apertures 82 for mating engagement with housing connector sleeve clips 58 in the same manner as cup assembly 20.

Fan assembly 14 includes a motor 84 coupled with housing partition 35 in supporting relationship. A drive shaft 86 extends rearwardly, axially supporting fan blades 88. Fan switch lead 90 intercouples exteriorly mounted control switch 92 with motor 84. Apertured rear housing body 26 includes an exterior retainer plate 94 for supporting a screen 96 in covering relationship.

Vibrator assembly 16 includes a transformer 98 and a conductive ring 100 remotely coupled by a lead 102. In preferred forms a pulse magnetic transformer is employed. Those skilled in the art will appreciate that a transformer modulated solenoid may also be employed. Housing lip 34 is configured to present an inwardly facing groove 104 which serves to support ring 100. A portion of transformer 98 projects outwardly from housing body 28 and is coupled with an exterior speed control switch 106.

As best shown in FIG. 2, power source 18 includes fan and vibrator leads 108, 110 intercoupling fan 14 and vibrator 16 respectively with a source of electricity. The preferred electrical power source provides alternating current, but direct current may also be employed. In such embodiments, a rectifier would be coupled with fan motor 84. Where power is externally supplied, as for example, from an electrical wall outlet, leads 108, 110 extend outwardly from housing 12 through a grommet 112 to a plug 114. Where electricity is supplied by an internal power source, as for instance, a battery power supply, a battery (not shown) would be substituted for grommet 112 and plug 114.

Housing 12, and massage assembly 22 are preferably formed of strong, lightweight impact-resistant materials such as fiberglass, synthetic resin, or lightweight metal such as aluminum. Cup 20 is preferably constructed of rubber or resilient synthetic resin to permit conformation of the cup in sealing relationship to the shape of the body part to be treated so as enhance the vacuum suction effect. In alternate embodiments cup 20 may be formed of an impact-resistant material similar to that employed in the construction of housing 12. Cup 20 may be also fabricated in a variety of sizes. Also in alternate embodiments a generally flat, planar member may be substituted for cup 20 to permit suction and massage of a circular area of the skin surface. Cup liner 72 is preferably of synthetic foam or other resilient, cushioning material which may be treated with an adhesive on the cup-contacting surface to prevent shifting or slipping during use. Annular rib 74 is preferably of integral construction to permit stretching over cup lip 68 to hold liner 72 in place. Bellows 54 is preferably of rubber or other resilient material such as flexible synthetic resin. In preferred embodiments fan and vibrator switches 92 and 106 are rheostats to permit infinitely variable speed control.

In use, plug 114 is inserted into an electrical outlet or, in alternate embodiments, a battery power source is inserted into housing 12. A user grasps apparatus 10 by handle stem 38, curving the fingers around finger grooves 42 and snaps cup 20 over sleeve 52 so that rib clips 58 engage apertures 76. Cup 20 is placed in sealing relationship over the body surface to be subject to vacuum massage, such as a breast, shoulder, hip, leg, stomach, or any other body portion. It will be appreciated that in certain applications the body surface to be treated may be clothed, so that cup 20 actually contacts a clothed body surface. Cushioning liner 72 permits comfortable placement of cup 20 adjacent the body part to be treated. Once the apparatus is positioned, a user selectively rotates fan control switch 92 to a desired position to cause rotation of blades 88 about drive shaft 86 and drawing of air inwardly from cup cavity 70, through shank portion 66, and rearwardly outward from housing 12 through screen 96, to cause a vacuum suction effect. The vacuum suction effect can be further modulated by selective shifting of baffle plate 46 over slot 48 between open and closed positions to admit more or less external air into the housing 12.

Vibrator transformer 98 is similarly activated by selective rotation of vibrator speed control switch 106 to a desired speed. Switch 106 activates vibrator ring 100, which in turn causes vibration of bellows 54, cup 20, and adjacent body surface in cup cavity 70.

Advantageously the vacuum suction and vibration effects may be independently modulated by means of control switches 92 and 106 to achieve a treatment mode of optimum user comfort. A user may even employ only the fan motor 84 to apply suction without massage, or only the vibrator transformer 98 to apply massage without suction.

In alternate embodiments, a user snaps cup 20 off sleeve 52 and snaps on massage assembly 22 so that clips 58 engage apertures 82. Vibrator massage head portion 78 is placed adjacent the body part to be subject to massage. Once the apparatus is placed in position, a user selectively rotates the speed control switch 106 to achieve the desired vibration speed. In the same manner as with cup 20, transformer 98 imparts a vibrating action to vibrator head 78. Advantageously, head 78 may be moved over the body surface to provide massaging action along the entire length of a muscle from its origin to its insertion.

The overall construction of the device results in a compact structure which is easily portable and may be conveniently stored when not in use. For example, the device may be transported in a gym bag or carry-all between home and exercise facilities for use in relieving tired or strained muscles.

It is to be understood that while certain forms of the present invention have been illustrated and described herein, it is not to be limited to the specific forms or arrangement of parts described and shown.

Having described the preferred embodiments of the present invention, the following is claimed as new and desired to be secured by Letters Patent:

1. An electrical pneumatic vacuum vibrator apparatus for contacting a body surface comprising:

(a) a housing having first, second, and third apertures and including a perforate partition segmenting said housing between said first aperture and said second aperture, said housing including a generally hollow cylinder flange member annularly surrounding said first housing aperture and projecting externally therefrom, said flange including an inwardly opening groove for supporting a vibrator conductive ring;

(b) a first body surface contacting assembly for cooperatively applying thereto a pressure differential and vibration force, wherein said first body surface contacting assembly includes a generally cup-shaped member including structure defining a cavity for receiving therein a body surface to be subjected to suction and vibration forces, said cup-shaped body surface contacting assembly including cushioning means for cushioning contact between said body surface and said first body surface contacting assembly, said first body surface contacting assembly further including a generally hollow cylindrical shank presenting a pair of opposed, slot-shaped apertures;

(c) a second body surface contacting assembly for applying thereto a vibration force, wherein said second body surface contacting assembly includes a generally bulb-shaped member having a generally arcuate head for contacting a body surface to be subject to vibration forces, said second body surface contacting assembly including a generally hollow cylindrical shank presenting a pair of opposed, slot-shaped apertures;

(d) a connector assembly including a generally hollow cylindrical sleeve member for supporting a body surface contacting assembly shank in telescoping relationship, said sleeve member having a first end adjacent said body surface containing assembly shank and a second end adjacent said housing, said first end including a pair of opposed clips for mating engagement within said slot-shaped shank apertures, and said second end including a shoulder presenting a recessed lip, said connector assembly including a generally hollow cylindrical bellow having a bore for telescopically receiving and fixedly intercoupling said housing flange and said sleeve member lip, wherein said first and second body surface contacting assemblies are interchangeably intercoupled with said housing b y said connector assembly;

(e) a blower fan coupled with said second aperture for exhausting air from said housing and drawing air therein through said body surface contacting assembly for creating a vacuum suction force in said body surface contacting assembly, said second aperture including a screen member in covering relationship for shielding said blower fan;

(f) a vibrator assembly having a pump, a conductive ring supportingly received within said housing flange groove, and a lead remotely intercoupling said pump and said ring for exerting vibrating action on said body surface contacting assembly;

(g) fan switch means for permitting independent control of said blower fan;

(h) vibrator switch means for permitting independent variable regulation of said vibrator;

(i) an adjustable baffle including a generally hemicylindrical sliding plate coupled in longitudinally sliding, overlapping relationship with said third housing aperture and positionable at open, closed and intermediate positions therebetween for permitting admission of air therethrough and adjusting said suction force exerted on said body surface, said baffle being oriented at a position of about 90° from said handle stem to permit positioning by the thumb of a user; and (j) a generally quadrant-shaped handle coupled with said housing for gripping said apparatus by a user, said handle including a generally arcuate portion coupled with a generally transverse stem, said stem further including groove members for facilitating gripping by the fingers of a user.

2. A method of cooperatively applying a pressure differential and vibration force to a body surface comprising the steps of:

providing an electrical pneumatic vacuum vibrator apparatus including (1) a housing having first, second, and third apertures and including a perforate partition segmenting said housing between said first aperture and said second aperture, said housing including a generally hollow cylinder flange member annularly surrounding said first housing aperture and projecting externally therefrom, said flange including an inwardly opening groove for supporting a vibrator conductive ring;

(2) a first body surface contacting assembly for cooperatively applying thereto a pressure differential and vibration force, wherein said first body surface contacting assembly includes a generally cup-shaped member including structure defining a cavity for receiving therein a body surface to be subjected to suction and vibration forces, said cup-shaped body surface contacting assembly including cushioning means for cushioning contact between said body surface and said first body surface contacting assembly, said first body surface contacting assembly further including a generally hollow cylindrical shank presenting a pair of opposed, slot-shaped apertures;

(3) a second body surface contacting assembly for applying thereto a vibration force, wherein said second body surface contacting assembly includes a generally bulb-shaped member having a generally arcuate head for contacting a body surface to be subject to vibration forces, said second body surface contacting assembly including a generally hollow cylindrical shank presenting a pair of opposed, slot-shaped apertures;

(4) a connector assembly including a generally hollow cylindrical sleeve member for supporting a body surface contacting assembly shank in telescoping relationship, said sleeve member having a first end adjacent said body surface containing assembly shank and a second end adjacent said housing, said first end including a pair of opposed clips for mating engagement within said slot-shaped shank apertures, and said second end including a shoulder presenting a recessed lip, said connector assembly including a generally hollow cylindrical bellow having a bore for telescopically receiving and fixedly intercoupling said housing flange and said sleeve member lip, wherein said first and second body surface contacting assemblies are interchangeably intercoupled with said housing by said connector assembly;

(5) a blower fan coupled with said second aperture for exhausting air from said housing and drawing air therein through said body surface contacting assembly for creating a vacuum suction force in said body surface contacting assembly, said second aperture including a screen member in covering relationship for shielding said blower fan;

(6) a vibrator assembly having a pump, a conductive ring supportingly received within said housing flange groove, and a lead remotely intercoupling said pump and said ring for exerting vibrating action on said body surface contacting assembly;

(7) fan switch means for permitting independent control of said blower fan;

(8) vibrator switch means for permitting independent variable regulation of said vibrator;

(9) an adjustable baffle including a generally hemicylindrical sliding plate coupled in longitudinally sliding, overlapping relationship with said third housing aperture and positionable at open, closed and intermediate positions therebetween for permitting admission of air therethrough and adjusting said suction force exerted on said body surface, said baffle being oriented at a position of about 90° from said handle stem to permit positioning by the thumb of a user; and

(10) a generally quadrant-shaped handle coupled with said housing for gripping said apparatus by a user, said handle including a generally arcuate portion coupled with a generally transverse stem, said stem further including groove members for facilitating gripping by the fingers of a user;

(b) placing a body surface to be subject to suction and vibration forces adjacent to said apparatus; and (c) activating said blower and vibrator to cooperatively apply a pressure differential and vibration force to said body surface.

3. The apparatus as set forth in claim 1, wherein said cushioning means is comprised of foam.

4. The electrical apparatus as set forth in claim 1, wherein said apparatus further includes a power supply.

5. The electrical apparatus as set forth in claim 1, wherein said power supply includes a battery.

* * * * *